US005942339A

United States Patent [19]

Garcia

[11] Patent Number: 5,942,339

[45] Date of Patent: Aug. 24, 1999

[54] PROCESS FOR APPLYING A COATING RESISTANT TO TEMPERATURE AND TO CORROSION CAUSED BY EXHAUST SYSTEM GASES OF AUTOMOTIVE VEHICLES AND OBTAINED COATING

[75] Inventor: Roberto Garcia, São Caetano doSul, Brazil

[73] Assignee: General Motors do Brasil LTDA., Sao Caetano Dosul, Brazil

[21] Appl. No.: 08/702,478

[22] PCT Filed: Mar. 9, 1995

[86] PCT No.: PCT/BR95/00017

§ 371 Date: Aug. 27, 1996

§ 102(e) Date: Aug. 27, 1996

[87] PCT Pub. No.: WO95/24516

PCT Pub. Date: Sep. 14, 1995

[30] Foreign Application Priority Data

Mar. 9, 1994 [BR] Brazil ..... 9400845

[51] Int. Cl.[6] ..... B32B 15/00

[52] U.S. Cl. ..... 428/680; 148/253; 148/254; 427/304; 427/305; 427/435; 428/684

[58] Field of Search ..... 427/304, 305, 427/435; 148/253, 254

[56] References Cited

U.S. PATENT DOCUMENTS

| | | | |
|---|---|---|---|
| 2,774,688 | 12/1956 | Girard | 117/130 |
| 2,876,116 | 3/1959 | Jendrynski | 106/1 |
| 3,080,643 | 3/1963 | Hanink | 29/156.8 |
| 3,887,732 | 6/1975 | Parker | 427/380 |

FOREIGN PATENT DOCUMENTS

| | | |
|---|---|---|
| 3742594 | 9/1979 | Germany . |
| 60-100685 | 6/1985 | Japan . |
| 61-246374 | 11/1986 | Japan . |
| 54123539 | 6/1989 | Japan . |

OTHER PUBLICATIONS

Patent Abstract, JPC–66, Dec. 5, 1979, vol. 3, No. 147, JP54 123539.

Patent Abstracts of Japan, vol. 9, No. 241 (C–306) (1964) Sep. 27, 1985, & JP,A, 60 100 685 (USUI Kokusai Sangyo K.K.) Jun. 4, 1985.

Patent Abstracts of Japan, vol. 11, No. 96 (C–412) (2543) Mar. 26, 1987, & JP,A, 61 246 374 (NEC Kansai Ltd) Nov. 1, 1986.

*Primary Examiner*—Michael Lusignan
*Attorney, Agent, or Firm*—Ladas & Parry

[57] ABSTRACT

This invention describes the coating of a nickel-phosphorous bond on steel sheets or pipes of common carbon steel with the aim of forming an Fe—Ni—P bond, using a process of diffusion and enabling the resistance of the exhaust gases to corrosion. The deposit, when submitted to continual use of the vehicle, forms an intermetallic layer, which each time protects the substrate against corrosion.

14 Claims, 2 Drawing Sheets

Figure 1:
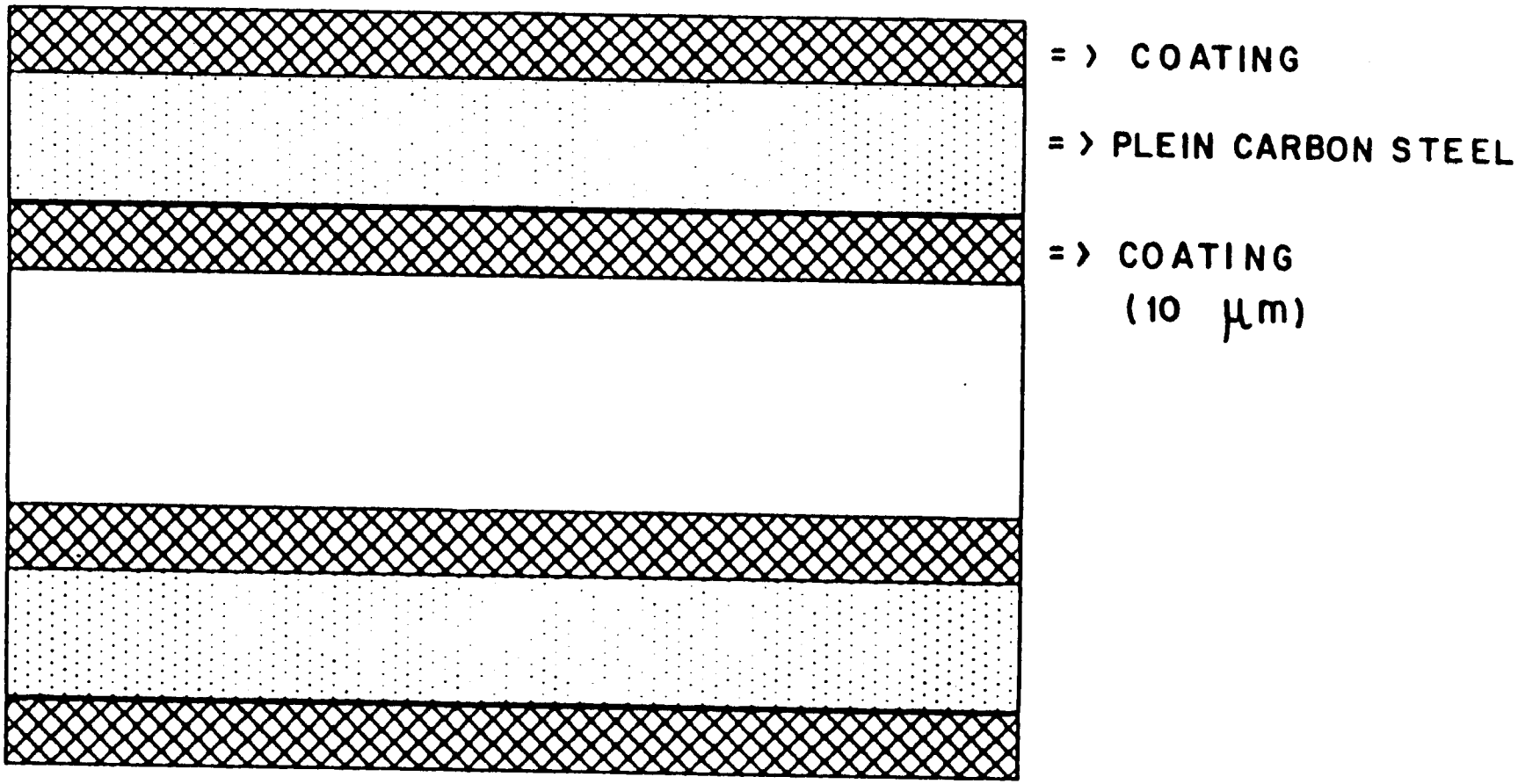

PROCESS FOR APPLYING A COATING RESISTANT TO TEMPERATURE AND TO CORROSION CAUSED BY EXHAUST SYSTEM GASES OF AUTOMOTIVE VEHICLES AND OBTAINED COATING

The present invention concerns a coating applied to a sheet of steel or a pipe of common carbon steel.

When applied to common carbon steel, the referred coating provides it with special characteristics, allowing its use in the parts of vehicle exhaust systems, which by law regulations have to be fitted with catalytic converters.

Prior to PROCONVE (Program of Vehicle Emission Control) requirements, the primary pipe of an exhaust system could be made from common carbon steel. This material, when in use in the vehicle, underwent an oxidation process on its internal surfaces, due to the elevated temperatures (near the exhaust manifold, the temperature is around 800° C., and far from it, it is approximately 600° C.)

The result of iron corrosion, at elevated temperatures, is normally an adherent oxide, forming a film (inert to the exhaust gases) above the substrate (common carbon steel).

Due to the usage of the vehicle, the pipe undergoes thermocycles (warming and cooling), associated with the vibration of the motor, initially causes fissures to occur within the adherent film and later, the flaking of iron oxide from the substrate.

When the iron oxide detaches itself from the substrate, it leaves it susceptible to a new oxidation process by elevated temperatures, forming again the adherent film, as explained previously With the subsequent use of the vehicle, the film breaks once again and the process is repeated innumerable times, as follows: (a) corrosion of the substrate; (b) formation of the adherent film (inert); (c) fissuring and subsequent breaking of this film: (d) flaking of the oxide formed; and (e) substrate exposure and, in this way, the restarting of the corrosion process of the substrate.

The flaking of the oxide formed in the referred conditions does not affect the performance of the exhaust system, provided that the vehicle does not utilize a catalytic converter.

With the advent of the requirements of maximum emission levels for vehicles (PROCONVE), the use of a catalytic converter became necessary; and, in this way, the internal corrosion of the primary exhaust pipe, previously not objected to, now constitutes a limiting factor in the use of common steel piping, since the flaking of the iron oxide will block and interfere with the metals which exist in the absorbent bed of the catalytic converter, considerably diminishing its performance and no longer permitting it to abide by the requirements of PROCONVE.

This being the case, the use of catalytic converters requires the use of corrosion-resistant and high-temperature-resistant steel; and the most commonly used such steel is the stainless steel type SAE 51409.

This raw material to be made into pipes requires a specific chemical composition, such as: carbon 0.12% maximum, titanium (or niobium)=0.75% maximum and chromium=10 to 12%, it being the case that these elements are fundamental in order to acquire the properties necessary for the defined application (primary exhaust system pipe resistant to elevated temperatures and corrosion).

When carrying out welding operations which are required to produce the final configuration of the primary pipe, when stainless steel is used, the usage of special welded frames is required in specific cases, since during the melting process changes may occur in the microstructure of the metal base (stainless steel) that which significantly alter its chemical and mechanical properties.

One object of the invention is the possibility of the use of common carbon steel with a nickel coating which, when applied onto the internal areas of the pipe forms a common steel/coating system, resistant to elevated temperatures and corrosion produced by the exhaust gases.

A more specific object of this invention is the ease with which one can use common carbon steel and consequently have greater productivity due to the operational simplifications of the final configuration of the primary pipe, since it avoids the use of welded frames, and there are no significant alterations on the microstructure of the material.

Yet another object of this invention is to use an easily available and recyclable material common carbon steel.

BRIEF SUMMARY OF THE INVENTION

An objective of the invention is to use common carbon steel, principally on the internal surfaces of the primary pipes of vehicles fitted with catalytic converters to conform with the requirements of PROCONVE, the common carbon steel being resistant temperatures and corrosion due to the exhaust gases. These and other advantages are obtained with the coating of nickel, by a process called self-catalysis.

In this process, the primary pipe, already in its final configuration, is immersed in chemical solutions normally used in the preparation of surfaces in galvanic baths, such as for example: chemical degreasing, cathodic electrode degreasing, de-oxidizing, chemical stripping and neutralization.

Immediately after neutralization, the part is immersed in an activation solution (which turns the $Fe^{2+}$ ions of the substrate into a condition to react with a nickel deposition bath.)

After the activation, we carry out a self-catalytic nickel deposition process, which is obtained by depositing the object (the primary pipe) in a bath containing nickel sulphate ($NiSO_4$), Sodium hypophosphite ($NaH_2PO_2$ $H_2O$), with specific additives brighteners and refiners.

During the chemical reactions between the substrate ($Fe^{2+}$ ions) with the nickel sulphate salts, a reduction reaction occurs, and nickel metal ($Ni^0$)is obtained. The reaction is promoted by the sodium hypophosphite and the other constituent of the bath. As it is a chemical reaction between the substrate and the bath, the conditions of concentration and of temperature must be continuously monitored and any necessary adjustments must be made immediately, with the aim of obtaining a deposit that is adherent, compact, regular and that has defined crystalline structure, in all areas of the part, both internally and externally.

It should be pointed out that these baths need specific control of concentration: a pH between 3 and 7, a concentration of nickel between 4 and 8 g/l and a concentration of sodium hypophosphite between 70 and 120 g/l. The conditions of temperature need to be between 60 and 90° C.

The deposit is actually a nickel-phosphorous bond, it being the case that the concentration of phosphorous is of fundamental importance. In this case the concentration of phosphorous must be between 6 and 10%. As the rate of deposition is constant, the thickness of the deposit is a function of time; and, in the case of the conditions indicated previously, around 10 $\mu$/hour, at minimum.

Nickel has a melting temperature of 1452° C. and is chemically inert to the exhaust gases (HC, CO and $NO_x$).

It also easily oxidizes at ambient temperature, forming a superficial film of NiO.

During the use of the vehicle, in the primary pipe coated with bonded nickel-phosphorous, the oxidation of nickel is accelerated due to high temperature, initially forming a semi-stable oxide, $Ni_2O_3$, at 400° C., and, above 600° C., it forms a stable oxide of NiO, darkening the layer and causing an intergranular diffusion from the coating to the interior of the substrate, it being the case that, after its use, an intermetallic layer made from iron-nickel-phosphorous (Fe—Ni—P) on the (i.e., a common steel pipe (substrate)/nickel-phosphorous coating), is created.

This intermetallic compound (Fe—Ni—P) is responsible for the improved adherence of the layer, consequently avoiding a possible flaking of the coating when the pipe is subjected to thermal cycles of the type involving heating and cooling. The diagram included shows schematically the arrangement of the coating before and after the use of the primary pipe in vehicles.

In this diagram:

FIG. 1 is a schematic diagram of the invention looking at a cross section of a primary pipe, with the coating applied on both sides (internally and externally), without being used.

Figure 2:
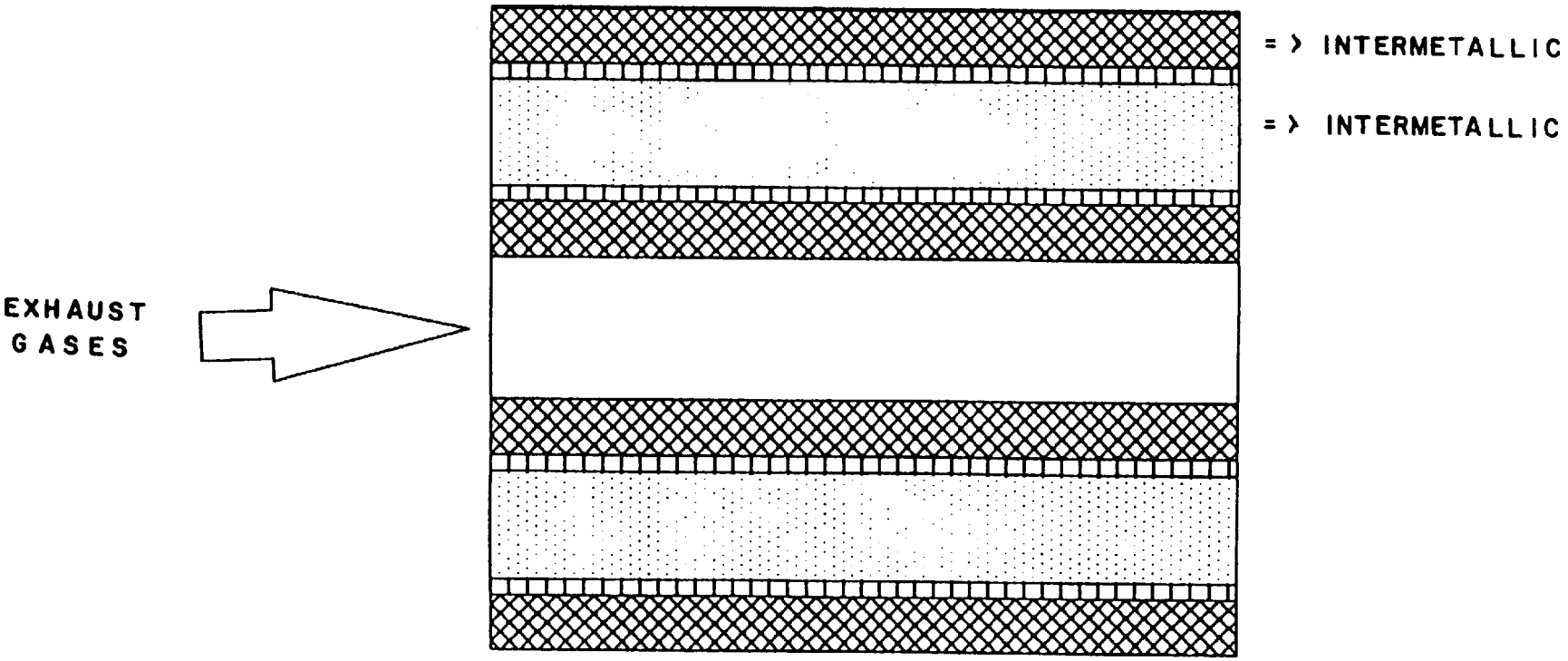

In FIG. 2, a schematic diagram of the invention considering a cross section across the primary pipe with the layer applied on both sides (internal and external) after its continuous use in a vehicle, stressing the intermetallic composition.

Primary pipes of the vehicle Omega were made following this present invention (with 10$\mu$ layer, minimum) and submitted to tests in the General Motors of Brazil Field of Tests, in Indaiatuba, State of São Paulo, Brazil. The vehicle (unit 3 V 4109) was subjected to procedures EPA 75 and EPA 74; and readings of the exhaust gases were taken before and after the catalytic convener and using the same vehicle with normal production parts (stainless steel type SAE 51409). It was possible to verify that the emissions of HC, CO and $NO_x$, were practically identical.

In other words, no significant differences were found between the result from the tests carried out on unit 3 V 4109, when it was equipped with the normal production part (stainless steel) and when it was equipped with the part constructed and defined by the invention (Relative to ECP 32294).

The above construction was also subjected to an accelerated corrosion test at the General Motors Field of Tests and the results obtained were considered satisfactory to the general purpose of the invention.

In order to insure that the invention offers a major cost/benefit relationship, other alternatives were considered and evaluated, as follows:

I. A layer of 20$\mu$ of nickel was deposited both internally and externally; and II. A layer of 10$\mu$ of nickel was deposited on the internal surfaces of the pipe, and a multi-layer system consisting of 5$\mu$ of nickel, later a layer of 5$\mu$ of copper, and finally another layer of 5$\mu$ of nickel was deposited on the external surface of the pipe.

Alternatives I and II were also subjected to accelerated corrosion tests at the General Motors Field of Tests. In view of the objective of this invention, the results were not satisfactory, taking into consideration the cost-benefit /benefit relationship.

We do not have knowledge of any use in practice of the process specified in this invention. Notwithstanding that there are many other materials which are resistant to corrosion and elevated temperatures, not one of them, according to our understanding shows the advantages described herein.

Although the invention has been presented in terms of its ideal situation, it should be noted that other forms and compositions could be easily adapted by the experts in the field. Therefore, the invention is to be limited only to the scope of the claims which follow.

I claim:

1. A method for improving the temperature or corrosion resistance of a pipe for use in an exhaust system of an automotive vehicle, said pipe comprising carbon steel, said method comprising immersing the pipe in a bath having components comprising nickel sulphate and sodium hypophosphite, said bath having a pH between 3 and 7, a concentration of nickel between 4 and 8 g/l, a concentration of sodium hypophosphite between 70 and 120 g/l, and a temperature between 60 and 90° C., said components being present in the bath in respective amounts such that immersion of the pipe in the bath causes a nickel-phosphorous coating to be deposited onto the pipe, with phosphorous being present in the coating in an amount of between 6 and 10% by weight, and such that, at a temperature of about 400° C., the nickel in the coating will oxidize to form a semi-stable oxide, $Ni_2O_3$, and at temperatures above 600° C., the nickel in the coating will oxidize to form a stable oxide of NiO accompanied by formation of an intermetallic layer of iron-nickel-phosphorous at an interface between the pipe and the coating.

2. A method as claimed in claim 1 wherein the carbon steel does not contain titanium, niobium or chromium.

3. A method as claimed in claim 1 wherein the method comprises inserting the pipe into the exhaust system of the automotive vehicle.

4. A method as claimed in claim 3 wherein the vehicle is operated such that the pipe is exposed to exhaust gases of the vehicle at a temperature of at least 400° C. whereby the nickel in the coating oxidizes to form the semi-stable oxide.

5. A method as claimed in claim 4 wherein the vehicle is operated such that the pipe is exposed to exhaust gases at a temperature of at least 600° C. whereby the nickel in the coating oxidizes to form the stable oxide.

6. A method as claimed in claim 1 wherein, prior to immersing the pipe into the bath, the pipe is immersed in an activation solution which prepares $Fe^{2+}$ ions in the carbon steel to react with the nickel-deposition bath.

7. A pipe produced by the method of claim 1.

8. A pipe produced by the method of claim 2.

9. A pipe produced by the method of claim 3.

10. A pipe produced by the method of claim 4.

11. A pipe produced by the method of claim 5.

12. A pipe produced by the method of claim 6.

13. A pipe/composite comprising a pipe of carbon steel, an internal layer, an external layer, a first intermetallic layer between the pipe and the internal layer, and a second intermetallic layer between the pipe and the external layer, each of said internal and external layers comprising bonded nickel-phosphorous with the phosphorous being present in each of said internal and external layers in an amount of between 5 and 10% by weight, each of said first and second intermetallic layers comprising iron-nickel-phosphorous.

14. A pipe/composite as claimed in claim 13 wherein the pipe consists essentially of common carbon steel which is free of chromium, titanium and niobium.

* * * * *